United States Patent [19]

Jundt et al.

[11] 4,275,702

[45] Jun. 30, 1981

[54] IGNITION SYSTEM FOR AN INTERNAL COMBUSTION ENGINE

[75] Inventors: Werner Jundt, Ludwigsburg; Herman Roozenbeek, Schwieberdingen, both of Fed. Rep. of Germany

[73] Assignee: Robert Bosch GmbH, Stuttgart, Fed. Rep. of Germany

[21] Appl. No.: 56,962

[22] Filed: Jul. 12, 1979

[30] Foreign Application Priority Data

Jul. 29, 1978 [DE] Fed. Rep. of Germany ..... 2833435

[51] Int. Cl.[3] ..... F02P 3/04

[52] U.S. Cl. ..... 123/610; 123/644; 315/209 T

[58] Field of Search ..... 123/148 E; 315/209 T

[56] References Cited

U.S. PATENT DOCUMENTS

| | | | |
|---|---|---|---|
| 3,605,713 | 9/1971 | Le Masters et al. | 123/148 E |
| 4,043,302 | 8/1977 | Sessions | 123/148 E |
| 4,112,904 | 9/1978 | Uno et al. | 123/148 E |
| 4,153,032 | 5/1979 | Château | 123/148 E |
| 4,176,645 | 12/1979 | Jundt et al. | 123/148 E |

FOREIGN PATENT DOCUMENTS

| | | | |
|---|---|---|---|
| 2701967 | 7/1978 | Fed. Rep. of Germany | 123/148 E |

*Primary Examiner*—Ronald H. Lazarus
*Assistant Examiner*—Andrew M. Dolinar
*Attorney, Agent, or Firm*—Frishauf, Holtz, Goodman & Woodward

[57] ABSTRACT

In order to optimize the on/off ratio of the output switch in an electronic ignition system in which a monostable multivibrator is triggered by rpm-dependent transducer pulses, the time constant of the multivibrator may be changed by altering the discharging characteristics of its timing capacitor. A current-limiting circuit senses the current through the output switch and applies a signal to a circuit point which controls the discharging rate of the timing capacitor. The current-limiting circuit also prevents further increases in the primary coil current when a limiting value is reached.

5 Claims, 1 Drawing Figure

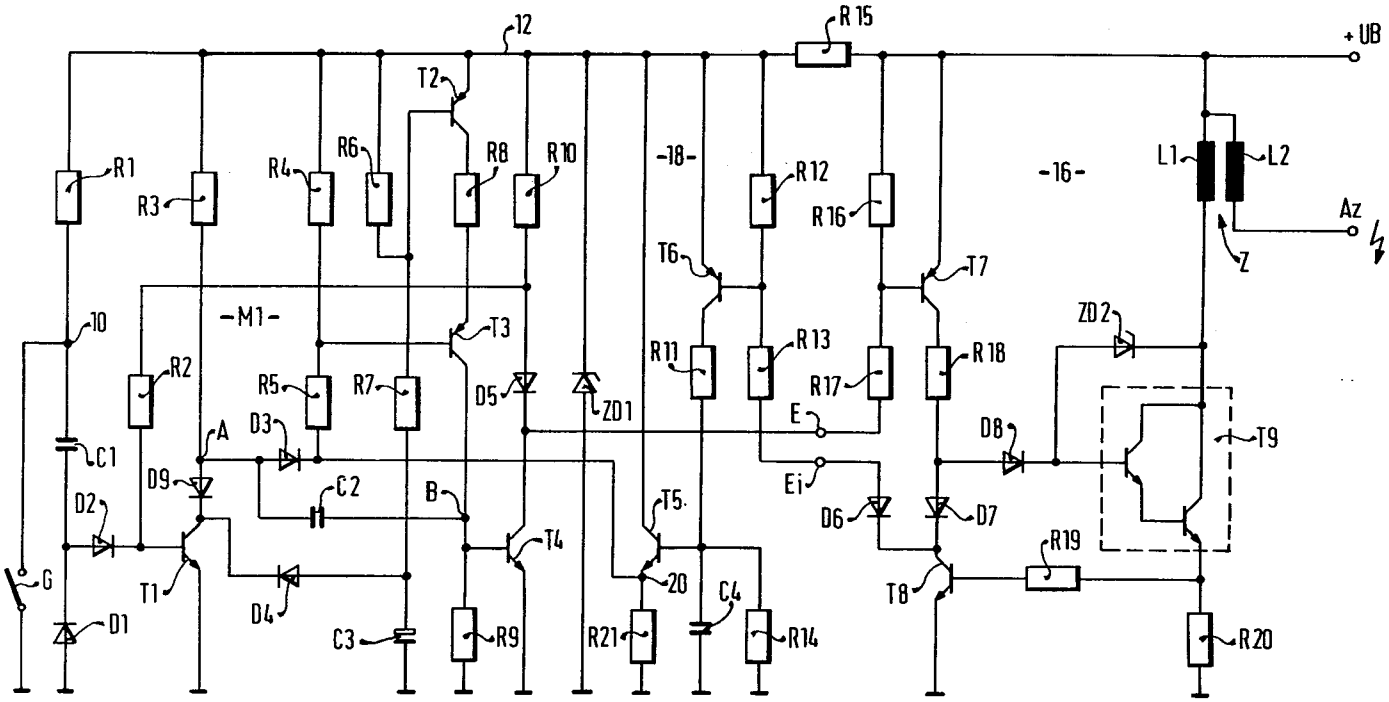
+UB
Az
L2
L1
Z
T9
R20
ZD2
-16-
R19
D8
D7
T7
R18
T8
R15
R16
R17
D6
R12
R13
E
E1
R14
C4
-18-
T6
R11
T5
20
R21
ZD1
R10
T4
12
R8
T3
D5
R9
T2
B
R7
C3
R6
C2
R4
R5
D3
D4
-M1-
A
R3
R2
D9
T1
R1
10
C1
D2
D1
G

IGNITION SYSTEM FOR AN INTERNAL COMBUSTION ENGINE

FIELD OF THE INVENTION

The invention relates to electronic ignition systems for internal combustion engines. More particularly, the invention relates to ignition systems in which a transducer generates an rpm-proportional signal which ultimately controls an electronic switch in the primary winding circuit of the ignition coil.

BACKGROUND OF THE INVENTION AND STATE OF THE ART

A known ignition system, for example as described in the German patent Publication DE-OS 27 01 967, includes a transducer which generates a speed dependent signal that is fed to a pulse shaping stage and triggers a monostable multivibrator. The multivibrator includes an integrating element or timing element, in particular a capacitor, which is charged from a constant current source during the ignition switch closure time and which is subsequently discharged after the monostable multivibrator is triggered and until such time as the voltage across the capacitor permits the return of the multivibrator into its stable state. The time during which the multivibrator is in its unstable state defines the open period of the ignition control switch. The known ignition system also provides for a parallel conduction path in the monostable multivibrator so as to permit the duty cycle of the transducer to control the on and off times of the ignition at low engine speeds and whenever the voltage across the capacitor exceeds a given level due to prolonged switch closure. While the known system is satisfactory in many instances, it has the disadvantage of generating ignition closure intervals at low rpm whose duration is unnecessarily long and which lead to power losses in the ignition system.

THE INVENTION

It is thus a principal object of the invention to provide an ignition system of the above-described type in which the ignition on-off times, and in particular the ignition output switch closure times, are optimized to reduce power losses.

An associated object of the invention is to provide an ignition system in which the output switch closure time is constant over substantially the entire engine speed domain so that a constant amount of ignition energy can be stored. Still another object of the invention is to provide the aforementioned ignition system with a minimum of technical expenditure.

According to the invention, an ignition system is provided in which current-limiting devices are associated with the output circuit of the ignition system so that the output signal of an integrating circuit may be increased, thereby shortening the unstable time interval of the monostable multivibrator of the ignition system. In one advantageous feature of the invention, the current-limiting device includes a measuring resistor in series with the primary windings of the ignition coil and a transistor controlled by the voltage across the measuring resistor. The transistor in turn reduces the base current of an output transistor of the system.

Other details and advantages of the invention will be discussed and explained with the aid of a schematic diagram of one preferred embodiment of an ignition system according to the invention.

BRIEF DESCRIPTION OF THE DRAWING

The single FIGURE of the drawing is a detailed circuit diagram of one preferred but non-limiting embodiment of an ignition system according to the invention.

DESCRIPTION OF THE PREFERRED EMBODIMENT

The input to the ignition system shown in the FIGURE is a transducer G which is illustrated as a simple switch and may in fact be a mechanical switch but is preferably embodied as a contactless inductive transducer. The switch G is connected between a reference voltage, for example vehicle or engine ground, and a circuit point 10 which is connected through a resistor R1, a line 12 and a resistor R15 to a positive supply voltage $+U_B$, for example the vehicle battery voltage. The circuit point 10 is connected via a first capacitor C1 to the cathode of a diode D1 the anode of which lies at reference potential or ground. The junction of the capacitor C1 and the diode D1 is connected to the anode of a second diode D2 whose cathode is the input terminal of a monostable multivibrator circuit M1 which includes three transistors T1, T3 and T4 of which the transistors T1 and T4 are illustrated as NPN-transistors whose emitters are grounded. The transistor T3 is a PNP-transistor. The base of the first transistor T1 is connected to the input of the multivibrator M1, i.e., to the cathode of the diode D2, whereas the collector of the first transistor T1 is connected to the cathode of a diode D9 whose anode communicates with the line 12 via a resistor R3. The anode of the diode D9 also constitutes a circuit point A which is connected to one electrode of a second capacitor C2, the other electrode of which constitutes a circuit point B. The point B is connected to the base of the output transistor T4 of the multivibrator M1 as well as to the collector of the third transistor T3. The base of the output transistor T4 is grounded through a resistor R9 whereas its collector is connected to the line 12 through a resistor R10 and to the base of the input transistor T1 through a feedback resistor R2. The base of the third transistor T3 is connected to the line 12 via R4 and through resistor R3 to the cathode of a diode D3 whose anode is coupled to the point A.

The monostable multivibrator circuit M1 includes a quiescent current shut-off circuit, namely a PNP-transistor T2 whose emitter is connected to the line 12 and whose collector is connected to the emitter of the third transistor via a resistor R8. The base of the transistor T2 connects through a resistor R6 to the line 12 and through the series connection of a resistor R7 and a third capacitor C3 to ground. The junction of the resistor R7 and the third capacitor C3 is also coupled to the collector of the input transistor T1 via a diode D4. Finally, the output 14 of the monostable multivibrator M1, which is defined by the collector of the fourth transistor T4, is connected to the input E of an output stage 16 of the entire ignition system.

The input E of the output circuit 16 is connected through resistors R16 and R17 to the positive battery voltage $+U_B$ and the junction of the two resistors R16 and R17 is connected to the base of the PNP-transistor T7 whose emitter is connected to the positive supply voltage $+U_B$. The collector of the transistor T7 is connected through a resistor R8 in series with a diode D8 to the base of an output transistor T9 which, as is commonly the case in transistor ignition output circuits, is embodied as a Darlington transistor circuit. The collector of the transistor T9 is connected to the primary windings L1 of an ignition coil Z, the other end of which is coupled to the battery voltage source. One side of the secondary windings L2 of the ignition coil is also connected to the battery voltage $+U_B$ while its other connection $A_z$ is a terminal for ignition spark pulses.

A zener diode ZD2 is connected in parallel to the output transistor T9 for protection against excessive output voltages. The emitter of the output transistor T9 is connected to ground through a measuring resistor R20 which constitutes a component of the current-limiting device which will be described in detail below. The current-limiting device according to the present invention includes a transistor T8 whose emitter is grounded and whose base is connected through a resistor R19 to the non-grounded side of the resistor R20 and whose collector is connected through a diode D7 to the junction of the resistor R18 and the diode D8. Furthermore, the collector of the transistor T8 is connected through a diode D6 to the input $E_i$ of the integrating section of the ignition system which will now be described.

The integrating system, collectively designated 18 in the FIGURE, includes a voltage divider consisting of two resistors R12 and R13 which are connected between the line 12 and the input point $E_i$. The tap of the voltage divider connects to the base of a PNP-transistor T6 whose emitter is also connected to the line 12 and whose collector is grounded through a voltage divider consisting of series resistors R11 and R14, the junction of which is grounded via a capacitor C4 and is also connected with the base of an NPN-transistor T5. The collector of T5 is joined to the line 12 and its emitter is grounded through a resistor R21 and is connected to the circuit point A via the diode D3.

Finally a zener diode ZD1 is connected between the line 12 and ground for stabilizing the voltage on the line 12.

The operation and function of the ignition system depicted in the single FIGURE and described above is as follows:

The monostable multivibrator circuit M1 including transistors T1, T2, T3, T4 generates output pulses whose duration defines the relative opening and closing times of the output circuit 16 and hence the energy and timing of the ignition sparks. In order to increase the control range for the duration of the output pulses of the multivibrator M1, the control voltage from the point 20 of the integrating system 18, i.e., from the emitter of the transistor T5, is applied to the junction of the resistor R5 and the diode D3. In this way, the control voltage affects both the discharge current of the capacitor C2 as well as the initial charging voltage. When the output transistor T4 of the multivibrator M1 conducts, the input transistor T1 is blocked so that the circuit point B, i.e., the one electrode of the capacitor C2, carries approximately 0.6 volt, i.e., the base-emitter voltage of the output transistor T4. Beginning at the time at which the output transistor T4 is rendered conducting, the voltage at the point A, i.e., at the other electrode of the capacitor C2, rises while the capacitor C2 is charged via the resistor R3 until the diode D3 whose cathode is connected to the control voltage becomes conducting. At this point the circuit junction A receives a voltage equal to the sum of the control voltage and the conduction voltage of the diode D3. At the point of ignition, i.e., when the switch or transducer G opens and the potential of the line 12 is applied to the circuit point 10, the input transistor T1 is rendered conducting by a short pulse applied through the first capacitor C1. This causes a negative voltage to be applied to the base of the output transistor T4 via the second capacitor C2, thereby blocking T4 while the input transistor T1 is held in the conducting state by the feedback resistor R2 even after the input pulse from the capacitor C1 has decayed.

From now on, the second capacitor C2 discharges substantially through the transistor T3 which is connected as a current source provided that the transistor T2 is conducting. The magnitude of the current flowing through the transistor T3 is influenced by the control voltage at the output 20 of the integrating system 18 which affects the transistor T3 via the resistor R8 in such a way that a low control voltage at the point 20 causes the current through the transistor T3 to be relatively high and vice versa. Accordingly, the second capacitor C2 discharges at a rate which may be high or low until the circuit point B receives the remanent base-emitter voltage of the output transistor T4, causing the latter to conduct and again block the input transistor T1.

The above-described function of the monostable multivibrator M1 is repeated cyclically and makes it evident that the duration of the output pulses can be adjusted in a relatively wide control range so that the transition to an uncontrolled constant, and thus maximum, ignition switch opening time can be shifted to engine speeds which lie below the idling speed. Furthermore, the transistor T2 and the associated elements R6, R7, C3 and D4 constitute a shut-off circuit for the quiescent current because when the engine speed becomes very low, approaching zero, the capacitor C3 charges so high that the transistor T2 is blocked, thereby also blocking the output transistor T4 which receives base current through the transistor T3 only when the transistor T2 conducts.

Once the output transistor T4 of the multivibrator M1 is rendered conducting, the input point E of the output circuit 16 is basically at ground potential so that a current flows through the resistors R16 and R17, causing the transistor T7 to become conducting and thereby feeding a base current to the output transistor T9 through a resistor R18 and a diode D8 which causes the output transistor T9 to conduct. As soon as T9 conducts, the current in the primary windings L1 of the coil increases and finally reaches a predetermined magnitude at which the voltage across the measuring resistor R20 is high enough to cause the transistor T8 to conduct and to carry away a part of the base current of the transistor T9 delivered by the collector of the transistor T7, thereby preventing any further increase in the magnitude of the current through the primary windings L1.

When the transistor T8 of the current control section becomes conducting, a potential is applied to the input $E_i$ of the integrating section 18 which causes a current flow through the resistors R12 and R13. This current which flows through the resistors R12, R13, the diode D6 and the transistor T8 renders the transistor T6 conducting and permits the capacitor C4 to charge through the resistor R11. The capacitor C4 can also discharge at all times through a parallel resistor R14 at some suitable rate. The voltage prevailing across the capacitor C4 is transmitted by the emitter-follower T5 to the circuit point 20 and affects the unstable time constant of the monostable multivibrator M1 in the manner already described.

In the ignition system of the present invention, the duty cycle of the transducer G never affects the relative duration of the opening and closing times of the ignition output switch. In a variant of the circuit illustrated, the electrode of the first capacitor C1 remote from the circuit point 10 may be connected directly to the base of the input transistor T1 of the multivibrator M1. If this is done, the ignition closure control remains independent of the duty cycle of the transducer G but the ignition opening time can never exceed the opening time defined by the duty cycle of the transducer G so that even when the engine which is equipped with the ignition system of the invention runs at extremely high speeds, the ignition closure time will always suffice to provide sufficient ignition energy.

The foregoing description relates to a preferred exemplary embodiment of the invention and a variant thereof. Other embodiments and variants are possible without departing from the spirit and scope of the invention.

We claim:

1. An ignition system for an internal combustion engine including an ignition coil (Z) having primary (L1) and secondary (L2) windings;

an ignition control transistor (19) serially connected to the primary winding;

an input transducer (G) coupled to the engine and generating engine speed-related signals;

a monostable multivibrator (M1) for generating ignition control signals for the control transistor (19) connected to and controlled by said input transducer;

an integrating circuit (18) for generating integrator output signals connected to said monostable multivibrator for changing the unstable time constant of said monostable multivibrator;

and a current limiting circuit (T8, D6, D7, R19, R20) connected to sense current flow in the primary winding (L1) including a measuring resistor (R20) connected in the primary winding circuit of said ignition coil (Z), and a current limiting transistor (T8) connected to and controlled by current flow through said measuring resistor and having a control output (Ei) connected to affect control current applied to the ignition control transistor (T9) to reduce current flow therethrough when the current through said measuring resistor (R20) reaches a predetermined value;

and wherein the control output (Ei) of said current limiting transistor is further connected to and controls said integrating circuit (18) to thereby control the integrator output signal in accordance with current flow through the primary winding of the ignition coil.

2. System according to claim 1, wherein said integrating circuit (18) includes an integrating capacitor (C4) and a transistor (T6), said transistor connected to and forming a current source for the integrating capacitor and being connected to and controlled by said current limiting circuit.

3. System according to claim 2, wherein the integrating circuit further includes an emitter-follower transistor (T5) forming an output circuit therefor and connected to sense the voltage across said integrating capacitor (C4) and transmit a signal representative of said voltage to said monostable multivibrator.

4. System according to claim 2, wherein the transistor (T6) connected to said intergrating capacitor is controlled to conduction when the current flow through the measuring resistor (R20) reaches a predetermined value and provides charging current to said integrating capacitor (C4).

5. System according to claim 2, wherein the integrating circuit further comprises a bleeder resistor (R14) connected in parallel with said intergrating capacitor and providing a discharge path for charge stored on the integrating capacitor (C4) when current through the measuring resistor (R20) drops below a predetermined value causing blocking of the transistor (T6) connected to said integrating capacitor (C4) and thus inhibiting current flow from the current source formed by said transistor.

* * * * *